US006581934B2

(12) United States Patent
Powell

(10) Patent No.: US 6,581,934 B2
(45) Date of Patent: Jun. 24, 2003

(54) GAME APPARATUS

(76) Inventor: Chris Powell, 113 Bishops Dr., Aston, PA (US) 19014

( * ) Notice: Subject to any disclaimer, the term of this patent is extended or adjusted under 35 U.S.C. 154(b) by 0 days.

(21) Appl. No.: 09/900,835

(22) Filed: Jul. 9, 2001

(65) Prior Publication Data

US 2003/0006551 A1 Jan. 9, 2003

(51) Int. Cl.[7] ..... A63H 23/08

(52) U.S. Cl. ..... 273/267; 273/236; 273/275; 273/242

(58) Field of Search ..... 273/156, 157 R, 273/158, 159, 160, 153 P, 153 S, 153 J, 236, 260, 261, 264, 267, 266, 271, 276, 281, 283, 284, 287, 288, 153 R, 155

(56) References Cited

U.S. PATENT DOCUMENTS

| | | | | | |
|---|---|---|---|---|---|
| 284,525 | A | | 9/1883 | Williams | |
| 340,296 | A | | 4/1886 | Dibble | |
| 402,017 | A | | 4/1889 | Howard | |
| 2,520,207 | A | * | 8/1950 | Graham | 273/242 |
| 3,863,926 | A | * | 2/1975 | White et al. | 273/267 |
| 4,032,151 | A | * | 6/1977 | Morse | 273/242 |
| 4,277,066 | A | * | 7/1981 | Hough | 273/267 |
| 4,419,081 | A | | 12/1983 | Steinmann | 434/188 |
| 4,555,116 | A | * | 11/1985 | Fields | 273/236 |
| 4,844,466 | A | | 7/1989 | Johnson et al. | 273/157 R |
| 5,108,291 | A | | 4/1992 | Kuo | 434/211 |
| 5,344,153 | A | * | 9/1994 | Watanabe | 273/261 |
| 5,439,221 | A | | 8/1995 | Harvie | 273/157 R |
| 5,553,854 | A | * | 9/1996 | Rum | 273/267 |
| 5,893,560 | A | | 4/1999 | McClelland | 273/157 R |
| 6,062,561 | A | * | 5/2000 | Wainwright et al. | 273/236 |
| 6,394,455 | B1 | * | 5/2002 | Denoual | 273/261 |

* cited by examiner

*Primary Examiner*—S. Thomas Hughes
*Assistant Examiner*—Alex F. R. P. Rada, II
(74) *Attorney, Agent, or Firm*—Robert S. Lipton, Esq.; Lipton, Weinberger & Husick

(57) ABSTRACT

The present invention is a game, as a board game or computer game, relating to visualization and completion of geometric shapes. Repeating geometric shapes appear on a game board. The geometric shapes share perimeter boundaries with other geometric shapes on the game board. Game pieces are provided that correspond to a portion of the perimeter of one or more geometric forms. Players place game pieces on the game board, completing the geometric shapes.

11 Claims, 10 Drawing Sheets

GAME APPARATUS

BACKGROUND OF THE INVENTION

1. Field of the Invention

The invention is a game involving visualization of geometric shapes and the completion of visual geometric puzzles.

2. Description of the Related Art

The board game is a staple of family entertainment. In a board game, the progress of the game is recorded on a playing surface. The playing surface is referred to in this application as a "game board." The game board serves as a record-keeping system to track the course of play and to provide players with a changing visual status report.

Many board games exist. A familiar example is the barter or trading game of Monopoly®, described in U.S. Pat. No. 2,026,082 issued to Darrow, Dec. 31, 1935. None of the games in existence provides for completion of geometric forms on a game board by combining game pieces in the manner of the present invention.

SUMMARY OF THE INVENTION

The invention is a game. The interest of the game is in visualizing and completing geometric figures, preferably squares, as quickly as possible. Lines are marked on a game board. The line segments between intersecting lines define the perimeters of geometric figures. The line segments are referred to as "perimeter portions" in this application. For purposes of this application, the term "geometric figure" means any shape which may be depicted by line segments and which may appear in a repeating pattern upon a game board.

Players are provided with game pieces that the player may manipulate and place on the game board. The game pieces comprise elongated members in any of several configurations. The game pieces correspond to one or more perimeter portions of one or more of the geometric shapes.

Players take turns placing game pieces on the board, with the elongated members of the game piece coextensive with perimeter portions. Game pieces may touch, but may not be coextensive with the same perimeter portion. A player scores by placing on the board a game piece that completes a geometric figure.

Players are provided with a set of different game pieces providing a variety of play and scoring opportunities. The successful player keeps track of the opportunities for completing geometric figures present on the board and visualizes the possibilities presented by the remaining game pieces in the player's set.

Game play is rendered more complex and challenging by several devices, as more fully described in the Description of the Preferred Embodiment below.

DESCRIPTION OF THE PREFERRED EMBODIMENT

Figure 1:
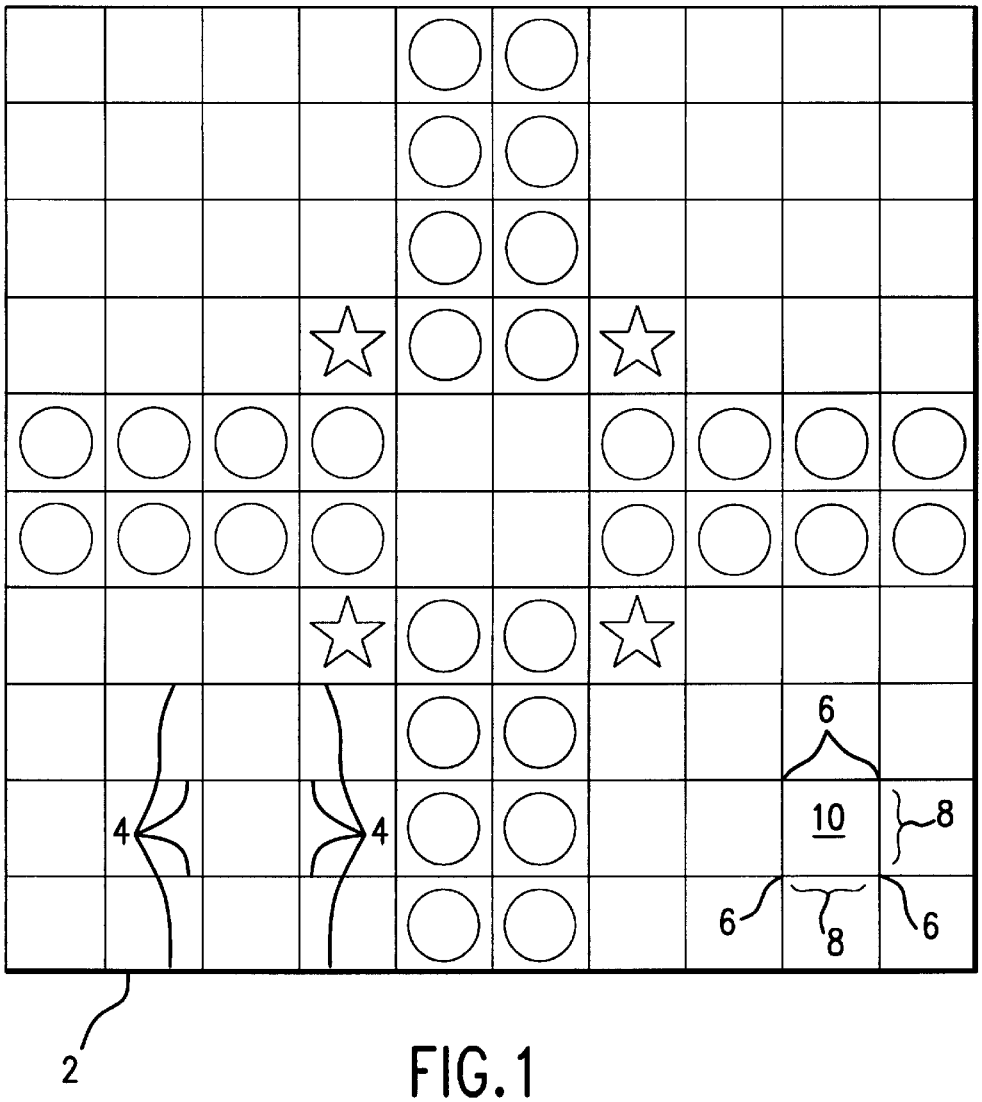
FIG. 1—game board.

As illustrated by FIG. 1, the preferred game board 2 is square in shape. Lines 4 are marked on the game board 2. The lines 4 intersect one with another and points of intersection 6 are created where lines 4 intersect. Line segments between points of intersection 6 are the perimeter portions 8. The perimeter portions 8 define a geometric shape, preferably a square 10.

The preferred game board 2 of FIG. 1 is divided into 100 squares 10, each of which is defined by four perimeter portions 8. Each square 10 shares perimeter portions 8 with two, three or four other squares 10.

Figure 2:
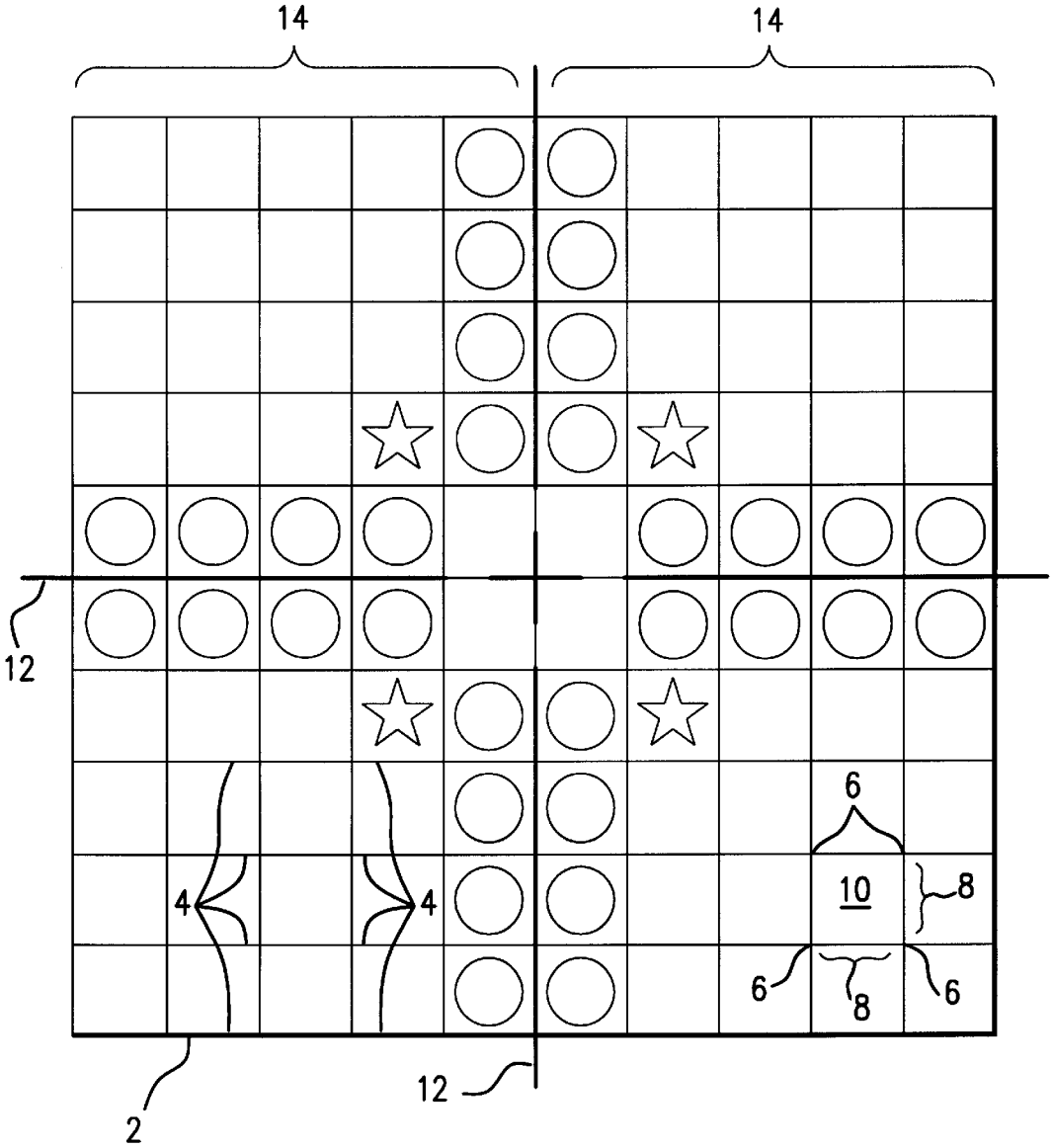
FIG. 2—game board showing quadrants.

The game board 2 has at least two axes of symmetry 12 about the center point (FIG. 2). The two axes of symmetry 12 are used to divide the game board 2 into quadrants 14. Each of the four quadrants 14 is marked to differentiate each quadrant 14 from each other quadrant 14. Preferably, each quadrant 14 is a different color from every other quadrant 14.

Figure 3:
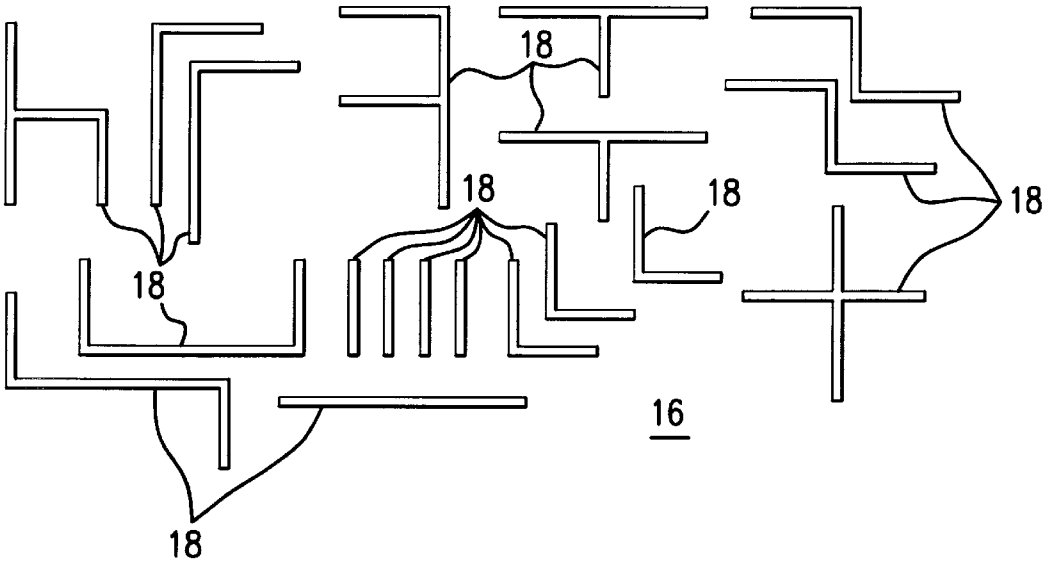
FIG. 3—one set of game pieces.

As shown by FIG. 3, at the start of the game each player is provided with one or more sets 16 of game pieces 18. Each game piece 18 within a set 16 is of the same color as every other game piece 18 of that set 16, and of a different color than the game pieces 18 of the other sets 16. The preferred number of sets 16 of game pieces 18 is four. The colors of the four sets 16 of game pieces 18 correspond to the colors of the four quadrants 14 of the game board 2.

If two players are playing a game, two of the four sets 16 are distributed to each player or team. If three players are playing, then one set 16 is distributed to each player and the players take turns choosing game pieces 18 from the remaining set 16 until all pieces 18 are chosen. If four players are playing, then each player is provided with one set 16 of game pieces 18.

Figure 4:
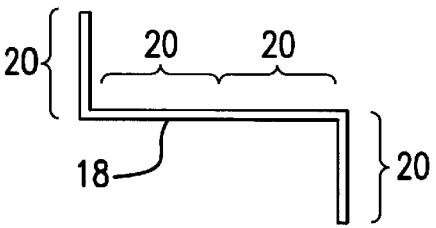
FIG. 4—example game piece

FIG. 4 depicts an example game piece 18. Each game piece 18 is comprised of one or more elongated members 20. The length and orientation of the elongated members 20 coincide with the length and orientation of the perimeter portions 8 forming a part of one or more squares 10 on the game board 2.

Figure 5:
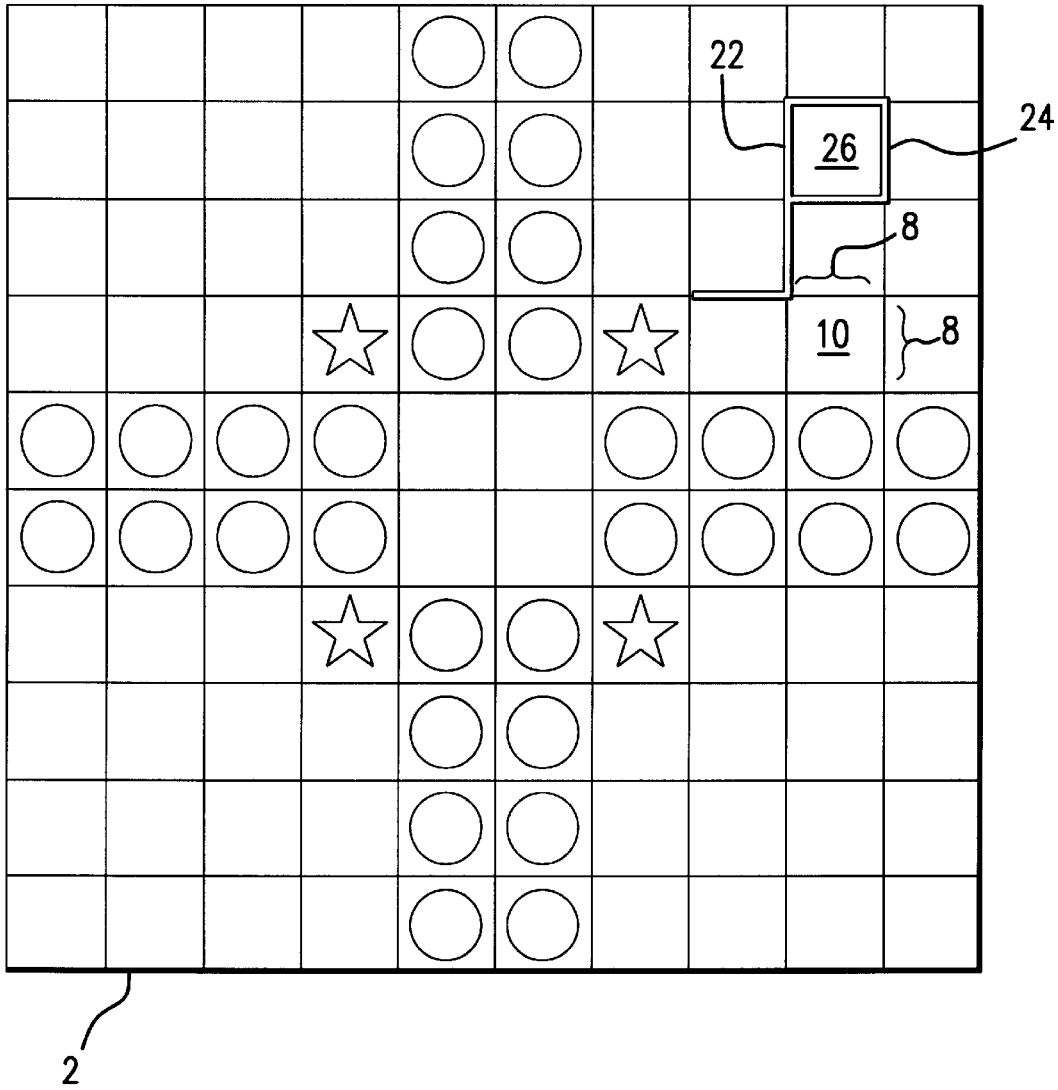
FIG. 5—Completion of a scoring figure.

As shown by the example of FIG. 5, when a game piece 22 is placed on the game board 2 with the elongated members 20 of the game piece 22 overlaying and coextensive with one or more perimeter portions 8. A second game piece 24, in combination with first game piece 22, may overlay all of the perimeter portions 8 defining a square 10, forming a scoring figure 26. The player who places the second game piece 24 completing one or more scoring figures 26 earns an increase in score of one point for each scoring figure 26 completed. FIG. 5 shows only one example of many different combinations of game pieces 18 that may complete a scoring figure 26.

Game play proceeds with each player taking turns placing game pieces 18 on the game board 2 and recording score increases for scoring figure 26 completed until either (a) a player has no game pieces 18 left, or (b) no locations exist on the game board 2 where the player can put down a game piece 18.

Figure 6:
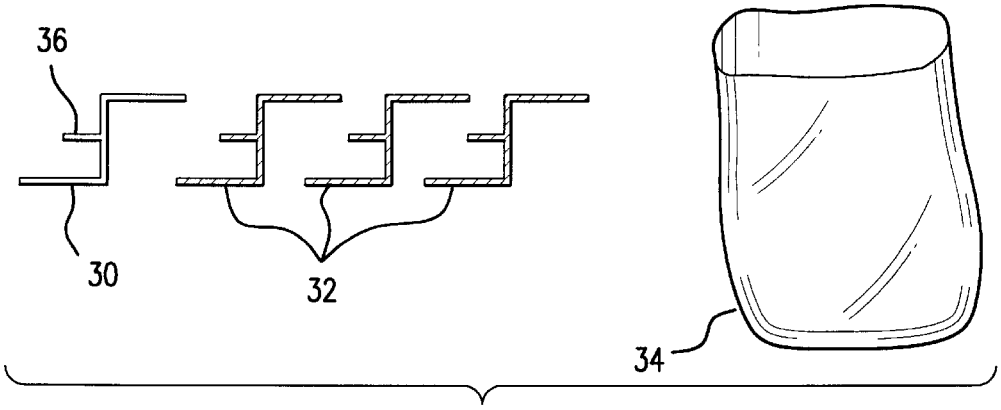
FIG. 6—bag with deduction piece and dummy deduction pieces.

Several additional conditions are placed on game play to make the game more complex and more challenging. First, a quadrant 14 and game piece set 16 of the same color are assigned to the player. On the game board 2, a deduction location 28 (FIG. 7) appears in each quadrant 14. A deduction piece 30 (FIG. 6) and three dummy deduction pieces 32 are distributed randomly to the players. In the preferred embodiment, the deduction piece 30 and the dummy deduction piece 32 are placed in a bag 34 and the players take turns drawing the deduction piece 30 and dummy deduction pieces 32.

In play, the deduction piece 30 and dummy deduction pieces 32 are placed on the board in the same manner as a game piece 18. The deduction piece 30 may not be placed on the game board 2 unless the player may thereby complete two scoring figures 26. Subsequently, another player may pick up the deduction piece 30 and place the deduction piece 30 in another location on the game board 2, so long as the player can complete two scoring figures 26 with the deduction piece 30.

Points are deducted from the scores of the players whose deduction locations 28 are closest and second closest to the deduction piece 30 at the end of the game. The location of the deduction piece 30 for determination of the closest and second closest deduction locations 28 is determined by a designation marker 36 extending from the deduction piece 30. The closest deduction location 28 is the deduction location 28 in the same quadrant as the deduction piece 30. The second closest deduction location 28 is determined by counting squares 10 from the square 10 indicated by the designation marker 34 to the deduction location 28.

Figure 7:
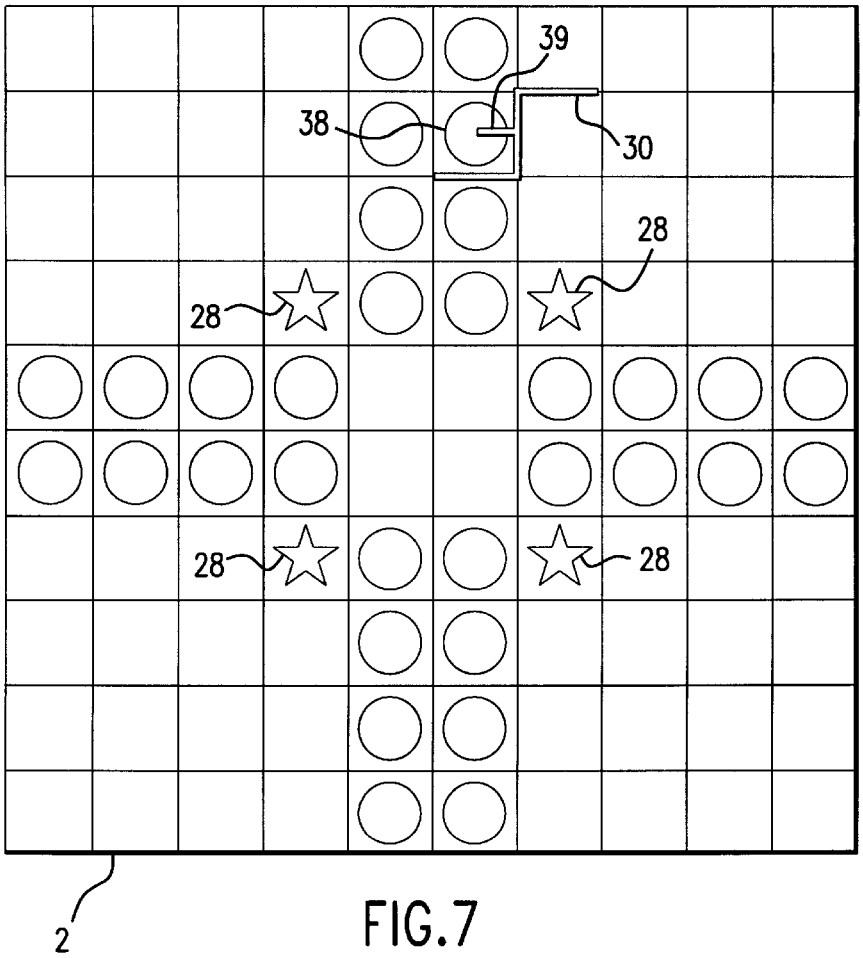
FIG. 7—scoring of deduction piece
Figure 8:
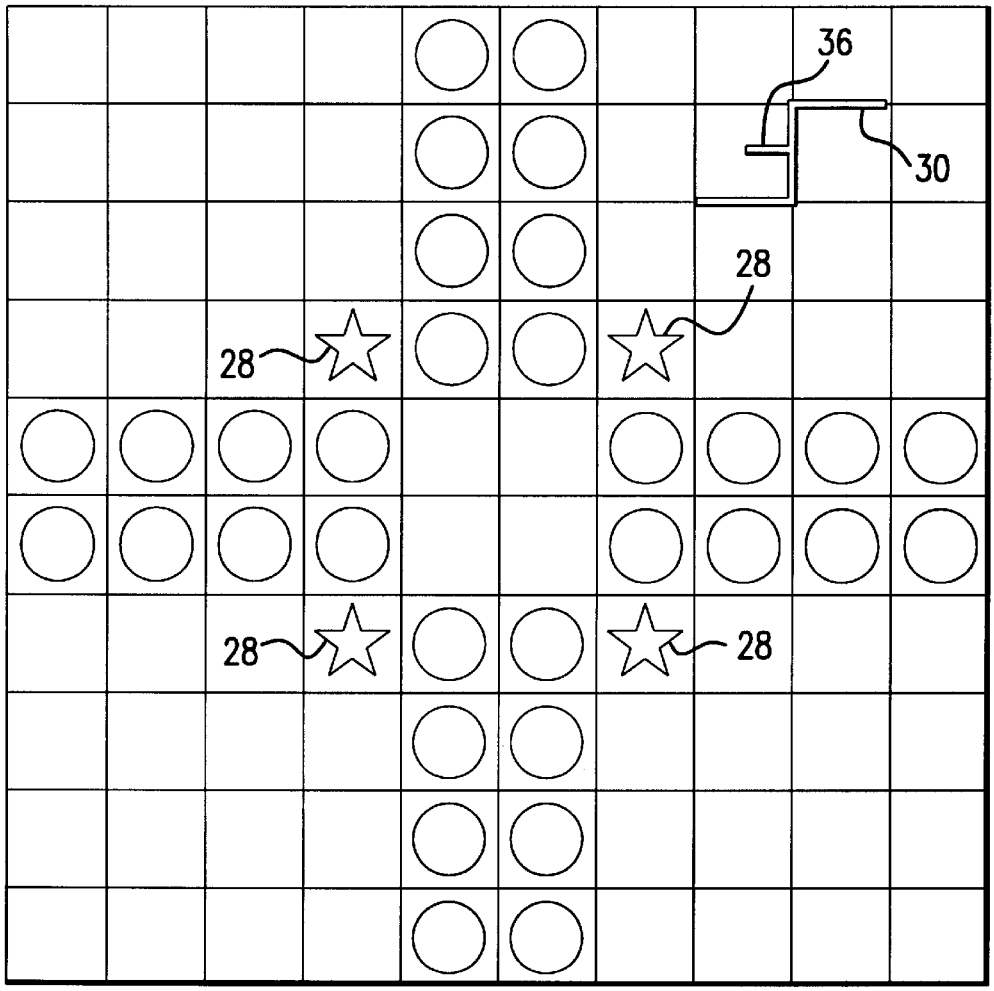
FIG. 8—second instance, scoring of deduction piece

As illustrated by FIG. 7, Circles 38 on the game board 2 assist in determining which deduction locations 28 are second closest to the deduction piece 30. If the deduction piece 30 designates a square 10 that contains a circle 38, then the deduction location in the quadrant adjacent to the circle is second closest to the deduction piece 30. From FIG. 8. if the deduction piece 30 is In a square 10 that does not contain a circle 38, then the deduction piece 30 is equidistant from the deduction locations 28 for the two adjoining quadrants 14. The players assigned all three quadrants 14 will have points deducted from their scores.

Figure 9:
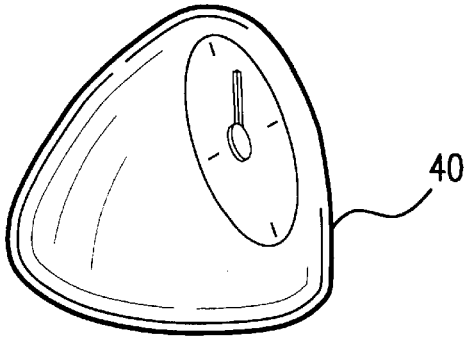
FIG. 9—timer.

A second device for increasing the difficulty and challenge of the game is a time limit of one minute on the placing of game pieces by a player. A timer 40 (FIG. 9) enforces the time limit. If a player places a game piece 18 on the game board 2 in less than one minute and successfully completes two squares 10, the player can use the remaining time to place another game piece 18 on the game board.

A third device for increasing the challenge of the game is that if all parts of a scoring figure 26 are composed of game pieces 18 from the player's set 16, then the player's score is enhanced. Preferably, the player earns a score increase of two points, rather than one, for each such scoring figure 26 completed.

A fourth device for increasing game complexity is that some of the game pieces 18 bear a mark 42 that will coincide with an intersection 6 of perimeter portions 8 when the game piece 18 is placed on the game board 2. If a player can place his or her game piece 18 bearing a mark 42 on the game board 2 such that the mark 42 covers a similar mark 42 on a previously placed game piece 18, then the player's score is enhanced. Preferably, the player's score for placing the game piece 18 bearing the mark 42 is doubled.

Fifth, if, at the end of the game a player has not played all of the player's game pieces 18, the player's score is reduced by a predetermined amount based on the nature and number of the game pieces 18 remaining in the player's set.

Sixth, each player selects three game pieces prior to the start of the game. The players place each game piece 18 on the game board 2 in turn prior to the start of the game to provide a framework for the subsequent game play.

Figure 10:
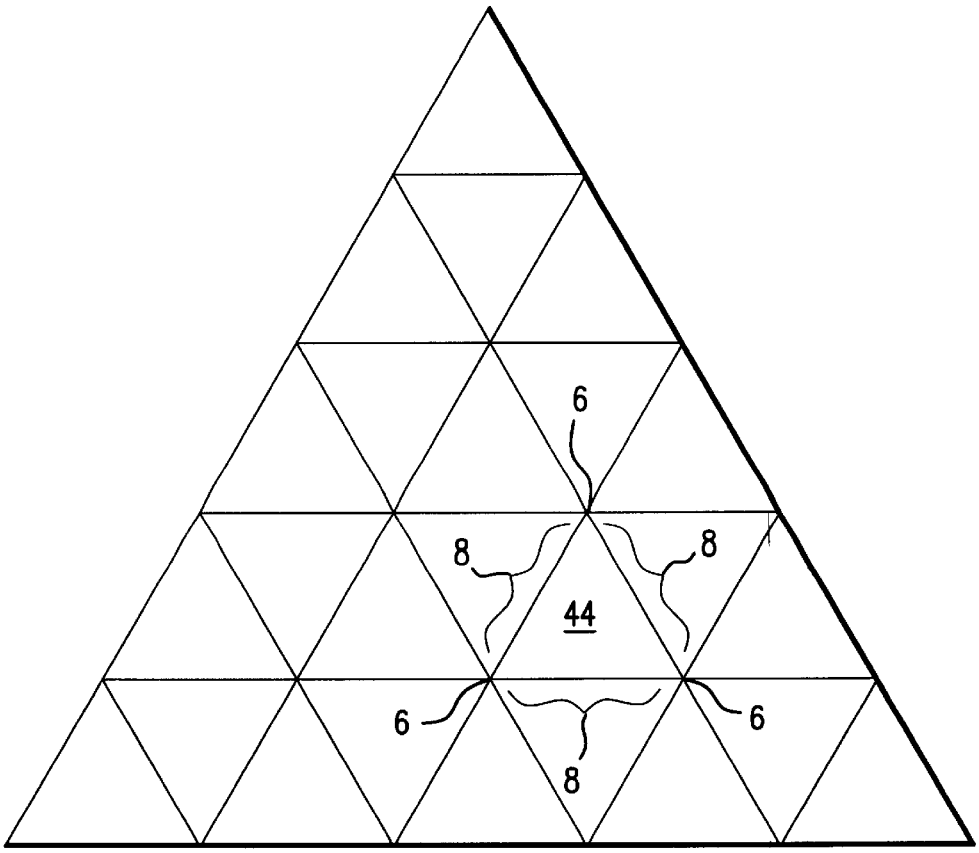
FIG. 10—triangular alternative embodiment.
Figure 11:
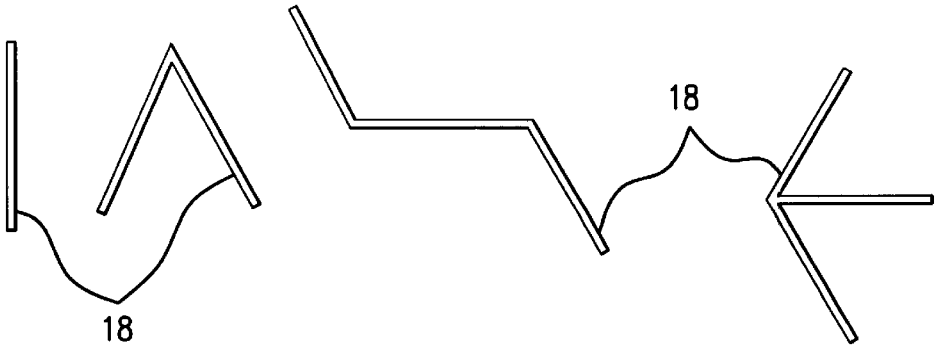
FIG. 11—example game pieces for triangular alternative embodiment

Although the foregoing description addresses squares 10, any geometric figure may be used as the basis of the game. As a first alternative embodiment, FIG. 10 shows a triangular game board 2 including lines 4 appearing thereon. The lines 4 cross at points of intersection 6. The line segments between the points of intersection are perimeter portions 8. The perimeter portions 8 define triangles 44. FIG. 11 shows example game pieces 18 for the triangular embodiment. The object of the triangular embodiment game, as in the preferred embodiment, is to place game pieces 18 on the game board 2 and to thereby form scoring figures 26. In the triangular embodiment, the scoring figures 26 are in the form of triangles 44.

Figure 12:
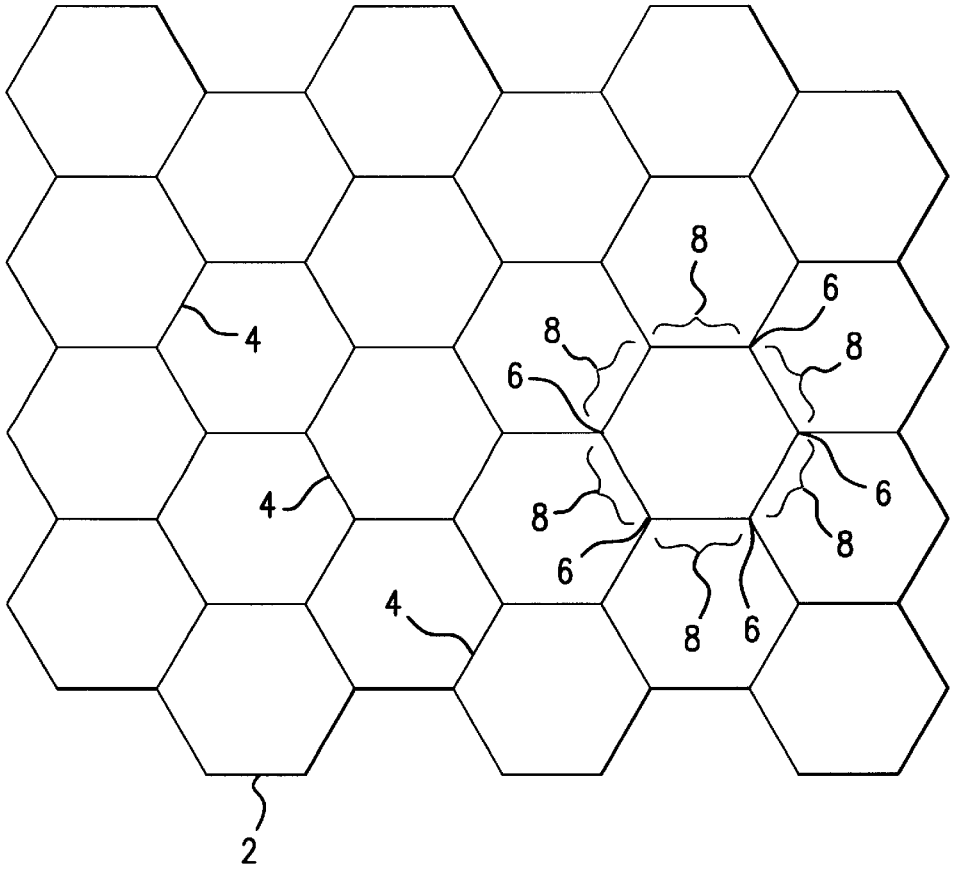
FIG. 12—hexagonal alternative embodiment
Figure 13:
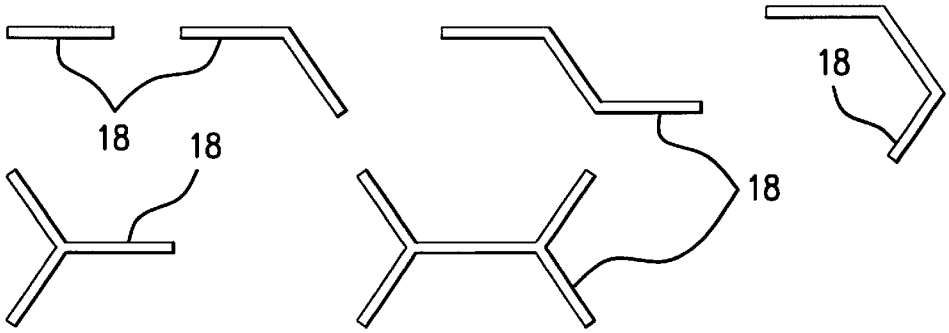
FIG. 13—example game pieces for hexagonal alternative embodiment

FIG. 12 shows a hexagonal alternative embodiment. In the preferred embodiment (FIG. 1) the lines 4 are straight and continuous across the game board 2. The hexagonal alternative embodiment (FIG. 12) illustrates that lines 4 are not required to be straight and continuous. In the hexagonal embodiment, the intersection points 6 of the lines 4 define perimeter portions 8. The perimeter portions 8 define hexagons 46. Example game pieces 18 for the hexagonal alternative embodiment are shown by FIG. 13. The point of the hexagonal embodiment is for a player to place the game pieces 18 on the board 2 and overlay the perimeter portions 8 to form a scoring figure 26 corresponding to a complete hexagon 46.

Figure 14:
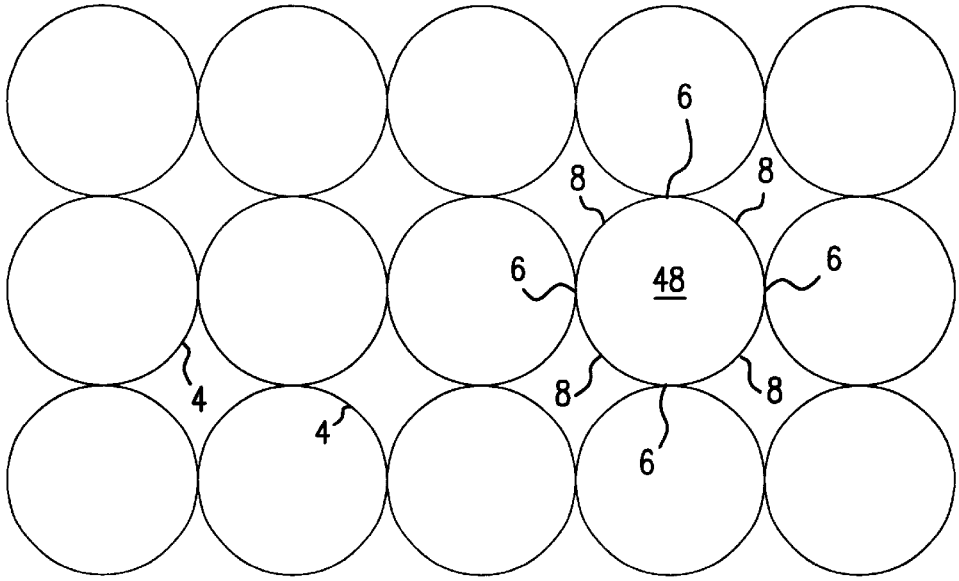
FIG. 14—circular alternative embodiment

FIG. 14 illustrates a circular alternative embodiment. As in the other embodiments, lines 4 meet to form intersection points 6. The line segments between the intersection points 6 define perimeter portions 8 of a geometric figure, in this case a circle 48. As in the other embodiments, the object of the game is to place game pieces 18 (FIG. 15) on the game board so that the game pieces 18 are coextensive with perimeter portions 8 so that two or more game pieces, in combination, form a scoring figure 26 in the form of a circle 48. FIG. 14 also illustrates that lines 4 are not required to be straight.

Figure 15:
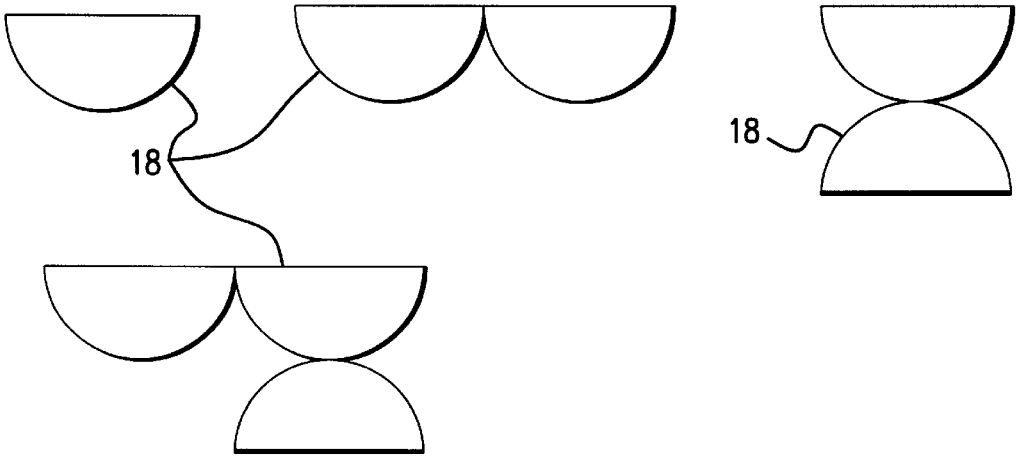
FIG. 15—example game pieces for circular alternative embodiment.

In the preferred embodiment, game pieces 18 (FIG. 3) are contiguous with the perimeter portion 8 of the square 10, but do not occupy the interior of the square 10. FIG. 15, illustrating example game pieces 18 for the circular embodiment, show that game pieces 18 for any embodiment may occupy the interior of the geometric figure, in this case a circle 48.

Figure 16:
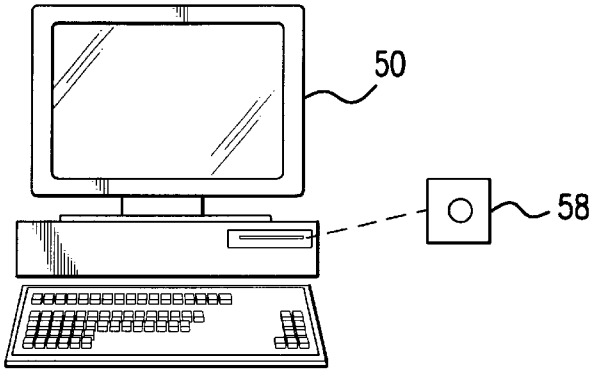
FIG. 16—computer.
Figure 17:
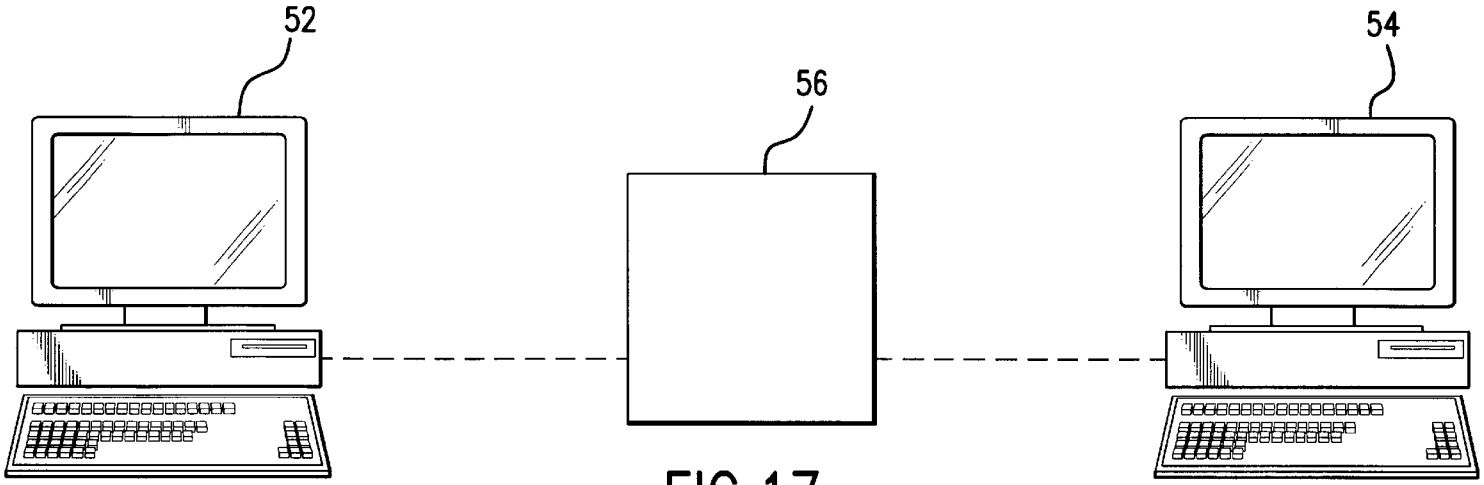
FIG. 17—client computer and server computer.

The game of the present invention may be played using a computer 50 (FIG. 16) programmed to display the game to a player. The game may be played using a client computer 52 (FIG. 17) programmed to receive information concerning the game from a server computer 54 over a computer network 56, such as the Internet. For purposes of this application, a client computer is any device capable of receiving information over a network. For purposes of this application, a client computer is any device capable of transmitting information over a network. Computer readable media 58, such as a CD, DVD, floppy disk or other media may be used to instruct computer 50, client computer 52 or server computer 54 to provide the game to a user. The computer based game may be played by a single player playing against the computer or two or more players playing against each other. The computer based game may include the computer as a player, playing against two or 3 players.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

I claim:

1. A game apparatus comprising:

a. a game board;

b. a plurality of perimeter portions appearing upon said game board;

c. a plurality of geometric figures defined by said perimeter portions such that each of said geometric figures is in apposition to and contiguous with a plurality of other of said geometric figures;

d. a plurality of game pieces, each of said game pieces comprising one or more elongated members, said elongated members corresponding to one or more of said perimeter portions such that a plurality of said game pieces are capable of being pieced on said game board and, in combination, said game pieces are coextensive with said perimeter portions that define one or more of said geometric figures; and e. said game pieces further occupying a central portion of some or all of said geometric figures formed.

2. The game apparatus of claim 1 further comprising a scoring figure defined by said game pieces placed on said game board in a manner such that said elongated members of said game pieces are coextensive with said perimeter portions defining a complete said geometric figure, whereby a score is enhanced of a player placing said game piece on said game board end thereby completing said scoring figure.

3. The game apparatus of claim 2 further comprising said geometric figures being squares.

4. The game apparatus of claim 2 said geometric figures being triangles.

5. The game apparatus of claim 2, said geometric figures being hexagons.

6. The game apparatus of claim 2, said geometric figures being circles.

7. The game apparatus of claim 2 further comprising:

a. said placement of each said game piece by each said player following a predetermined sequence;

b. means for limiting a time for placement of said game piece by each said player.

8. A game apparatus comprising:

a. a game board;

b. a plurality of perimeter portions appearing upon said game board;

c. a plurality of geometric figures defined by said perimeter portions such that each of said geometric figures is in a position to and contiguous with a plurality of other of said geometric figures;

d. a plurality of game pieces, each of said game pieces comprising one or more elongated members, said elongated members, said elongated members corresponding to one or more of said perimeter portion such that a plurality of said game pieces may be placed on said game board and, in combination, said game pieces may be coextensive with said perimeter portions that defined one or more of said geometric figures;

e. a scoring figure defined by said game pieces placed on said game board in a manner such that said elongated members of said game places are coextensive with said perimeter portions defining a complete said geometric figure;

f. a plurality of deduction locations appearing on said game board such that each of said players is assigned one or more said deduction locations;

g. a deduction piece having said elongated members corresponding to one or more of said perimeter portions such that said deduction piece may be placed on said game board and said elongated members of said deduction piece and said elongated members of said plurality of game pieces in combination may form said scoring figure; and h. whereby said score of one or more of said players may be reduced based on predetermined criteria dependent upon the proximity of said deduction location assigned to said player and said deduction piece.

9. The game apparatus of claim 8 further comprising a designation marker on said deduction piece, said designation marker Indicating a particular said geometric figure on said game board, said particular geometric figure determined by a location and orientation of said deduction piece.

10. The game apparatus of claim 8 further comprising means for randomly providing said deduction piece to one of said players such that said deduction piece may be placed on said game board during game play.

11. The game apparatus of claim 10 further comprising said means for randomly providing said deduction piece to one of said players comprising:

a. a bag containing said deduction piece;

b. a plurality of dummy deduction pieces, a number of said dummy deduction pieces being equal to one less than the number of said game pieces, whereby each of said players in turn may draw from said bag either said deduction piece or one of said dummy deduction pieces.

* * * * *